US009488199B2

(12) United States Patent
Nellessen

(10) Patent No.: US 9,488,199 B2
(45) Date of Patent: Nov. 8, 2016

(54) SUBSEA ACTUATOR WITH THREE-PRESSURE CONTROL

(71) Applicant: Peter Nellessen, Palm Beach Gardens, FL (US)

(72) Inventor: Peter Nellessen, Palm Beach Gardens, FL (US)

( * ) Notice: Subject to any disclaimer, the term of this patent is extended or adjusted under 35 U.S.C. 154(b) by 349 days.

(21) Appl. No.: 14/318,336

(22) Filed: Jun. 27, 2014

(65) Prior Publication Data

US 2015/0377257 A1 Dec. 31, 2015

(51) Int. Cl.

| | |
|---|---|
| ***F15B 11/00*** | (2006.01) |
| ***F15B 21/00*** | (2006.01) |
| ***F15B 11/036*** | (2006.01) |
| ***E21B 33/035*** | (2006.01) |
| *F15B 15/28* | (2006.01) |

(52) U.S. Cl.

CPC ..... *F15B 21/006* (2013.01); *E21B 33/0355* (2013.01); *F15B 11/0365* (2013.01); *F15B 15/28* (2013.01); *F15B 2211/212* (2013.01); *F15B 2211/6336* (2013.01); *F15B 2211/7056* (2013.01)

(58) Field of Classification Search

CPC ..... F16B 11/04; F16B 11/0365; F16B 15/28

USPC ..... 91/519

See application file for complete search history.

(56) References Cited

U.S. PATENT DOCUMENTS

| | | | | |
|---|---|---|---|---|
| 4,649,704 | A * | 3/1987 | Marsh | E21B 33/0355 60/413 |
| 6,244,560 | B1 | 6/2001 | Johnson | |
| 6,969,042 | B2 | 11/2005 | Gaydos | |
| 8,726,644 | B2 * | 5/2014 | Nellessen | F15B 1/02 60/398 |
| 2013/0098628 | A1 | 4/2013 | Van Wijk | |

* cited by examiner

*Primary Examiner* — John K Fristoe, Jr.
*Assistant Examiner* — Daniel Collins
(74) *Attorney, Agent, or Firm* — The Law Offices of Kevin M. Jones & Associates, LLC

(57) ABSTRACT

A subsea actuator comprising a plurality of chambers and at least three pressure levels, including an ambient pressure (medium), a substantially higher than ambient pressure (high), and an at or near surface atmospheric pressure or at a partial or full vacuum (low) to achieve a precise control of the actuator's closing force, speed, and stroke/position. The actuator enables full operations in emergency situations via manual or ROV operations; and can be operated (one way) to extend without supplied fluids in the event of high pressure failure emergency.

19 Claims, 4 Drawing Sheets

SUBSEA ACTUATOR WITH THREE-PRESSURE CONTROL

NOTICE OF INTENT TO RESERVE COPYRIGHT OR MASK WORK RIGHTS

Not Applicable

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of Invention

The present invention relates to underwater actuators and their control.

2. Background of the Invention

Underwater actuators may be required to be operated quickly. Actuators that use control fluids require a pressure source that is higher than the ambient pressure at the operating depth in order to operate. The pressure sources include pumps and gas charged accumulators. High flow pumps are required to operate high flow demand fluid actuators. However, accumulators may lose efficiency due to adiabatic discharge under high flow demands. As water depth increases, these devices become less efficient.

Existing designs have focused on increasing the efficiency of the positive pressure portion of the system that acts on the actuator piston and have ignored the potential to use the pressure generated at a depth as a source to operate the actuator. This focus has resulted in using either/or a combination of larger pumps, accumulators with higher gas pre-charge pressures, changing the pre-charge gas to helium instead of nitrogen, adding accumulators or increasing accumulator working volume capacity by using depth compensated accumulators in deep water. In deep water operations, these solutions decrease efficiency and reliability, add weight (by adding larger pumps or more accumulators), increase logistics issues (using helium instead of nitrogen as the pre-charged gas), or add complexity and potential for seal leakage due to cycling (depth compensated accumulators).

The inventor previously filed and was granted U.S. Pat. No. 8,726,644 where he employed a device, called a sub-actuator, which utilized a gas volume near atmospheric surface pressure, or lower to supply substantially a vacuum when the device is positioned for use at depth. This gas, at the lower pressure, coupled with fluid at depth or ambient pressure, and fluid at a high pressure, supplied by accumulators, umbilical lines, or other other methods, allowed the sub-actuator to assist in operation of an actuator in various situations with more precise control than has previously been accomplished in the industry. However, the sub-actuator and coupled actuator do not provided a simplistic compact package as desired in the industry.

SUMMARY

Described herein is an underwater actuator which produces in a single device, the functional operations of three-pressure control over a sub-sea actuator as was previously achieved by use of actuators and sub-actuators coupled together. The device has a chamber including at least three cavities. A fixed bulkhead divider creates two cavities, with a piston dividing at least one of the cavities further to create a minimum of three cavities. The piston is connected to a rod with the distal end extending through the remaining cavity and projecting from one end of the device and achieving a linear activation. The remaining cavity optionally including a second piston fixedly positioned on the rod dividing the remaining cavity into two cavities, thus resulting in a total of four cavities. The volumes of each cavity are related in size by the position of the rod and pistons. All cavities are sealed within the chamber against pressure, fluid, and/or gas leakage there between. The cavities vary in volume and pressure in compensation of external forces placed there between.

The system further comprising a plurality of valves to selectively connect the cavities of the actuator to either sources of high pressure or of medium pressure and allowing fluid to move freely between the actuator and the sources to cause the pistons to reposition, thus manipulating the actuator's rod position. The system optionally including accumulators, fluid supplies, reservoirs, purge valves, filters, vents, and other equipment, the specifics of which are not within the scope of this innovation.

The system further comprising three proximate pressures applied to differing cavities, thus moving the pistons and rods there between. The first pressure (high pressure) is applied by a fluid at substantially higher than underwater ambient pressure. The second pressure (medium pressure) is applied by a second fluid at or near underwater ambient pressure. The third pressure (low pressure) is applied by a gas at near surface atmospheric pressure, lower than surface atmospheric pressure, or a vacuum.

Operation of the actuator is accomplished by selectively applying pressure differential to the varying cavities of the actuator causing a repositioning of the pistons, and thus the rod, to vary the cavity sizes in an attempt to equalize pressure. The first pressure differential may be between the high pressure and the medium pressure, a second pressure differential existing between the medium pressure and the low pressure and a third differential existing between the high pressure and the low pressure. Each selectively applied for operation depending on the state of the system, the desired action, and speed and/or force of the actuator.

In the preferred embodiment, the high pressure is maintained by an accumulator, an umbilical fluid supply, or a subsea hydraulic power unit. One skilled in the art would appreciate that maintaining high pressure hydraulic fluids at depth is regularly accomplished in the industry and the particular method of doing so is not claimed within the scope of this innovation.

In the preferred embodiment, the medium pressure is maintained by a reservoir tank, an umbilical fluid line, an external vent to the environment at or near depth. One skilled in the art would appreciate that maintaining a medium pressure which is at or near ambient pressure at depth is regularly accomplished in the industry and the particular method of doing so is not claimed within the scope of this innovation.

In the industry, open circuit operations may be used in systems which use fluids that are not harmful to the environment, such as sea water. In such a system, rather than medium pressure reservoirs, medium pressure may be ambient pressure and fluids may be discharged to the environment. In such a system, high pressure may be generated by pumps which compress ambient fluid into high pressure reservoirs and/or supply lines.

In the preferred embodiment, the low pressure is maintained by a cavity which is equalized with ambient pressure at the surface and sealed prior to submersion. A gas purge value is maintained in the cavity which allows the pressure to be further established by reducing the cavity volume to near zero and venting any pressure generated by reducing the cavity volume into the environment. One skilled in the art would appreciate that this could be accomplished at any depth, as a volume of near zero would be insignificantly affected by depth and ambient pressures. Further external sources such as pumps, umbilical, remote vehicles, etc., may be attached to the appropriate cavity valve while manipulating the piston position to produce the correct pressure in the cavity with desired gas or fluid.

DETAILED DESCRIPTION OF THE INNOVATION

Figure 1:
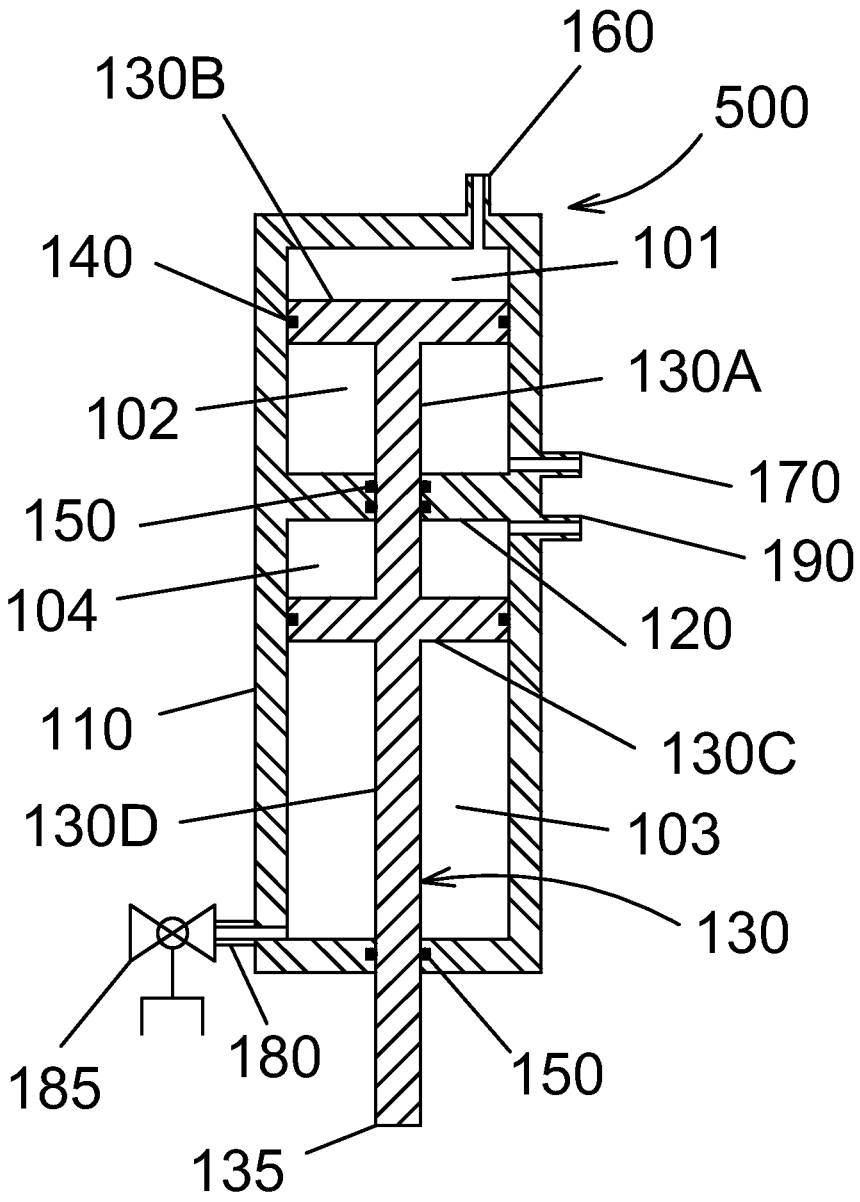
FIG. 1 illustrates a cross-sectional view of an actuator in accordance with an exemplary embodiment of the innovation.

The preferred embodiment, takes advantage of the fluid column which may be a fresh water or salt/sea water column or other appropriate fluid and which creates a higher underwater ambient pressure (a medium pressure) at a predetermined depth than at the surface of the fluid (a low pressure), and couples these with the normal high pressure sources to produce multiple pressure differences to operate the actuator directly or indirectly. The actuator uses the difference between medium pressure and low pressure to achieve a linear displacement of the rod or it may use the difference between high pressure and medium pressure to achieve a linear displacement of the rod.

A position sensor is incorporated into the actuator to allow monitoring of the rod's position. In the preferred embodiment, the position sensor is a magnetic sensor, which nests into a void in the central rod of the rod and piston assembly and extends from one end of the actuator's housing to approximately the bulkhead. This represents the full motion of the rod assembly as it is constrained by the piston within the cavity spanned by the rod. Running the position sensor down the center of the rod avoids having to secure the position sensor against leakage between cavities as it passes through the piston, as the void in the rod simply becomes a portion of the end cavity. The position sensor allows greater control of the actuator by determining exactly the stroke of the rod assembly, and the precise position at any given moment as well as a confirmation that activity has occurred.

In another embodiment, the position sensor may be a proximity sensor located on the wall of the housing which determines the location of the piston using other methods that are known to those skilled in the arts. In another embodiment, the position sensor may be a mechanical sensor and/or may be viewable external to the pressure chamber so as to allow direct monitoring by a diver or an ROV. The functional operation of the position sensor is beyond the scope of this application, and is not claimed as a part of this innovation. The claims are limited to the presence of the sensor and the monitoring of sensor results.

As discussed above, normal underwater actuators lose efficiency as water depth increases due to the decrease in pressure differential between the high pressure and the ambient pressure. By utilization of a low pressure chamber which is significantly lower than the ambient pressure, greater water depth's decreased pressure differential between the higher pressure and ambient pressure is compensated by the increased pressure differential between the ambient pressure and low pressure. Thus, when higher speeds or higher forces are desired, the pressure differential between the high pressure and the low pressure allows efficient piston and actuator operation.

The improved subsea actuator, shown in the figures, integrates the actuator and sub actuator from U.S. Pat. No. 8,726,644, which is incorporated herein by reference. It is a single actuator that uses positive pressure from accumulators, Remotely Operated Vehicles (ROVs), or from the surface, via umbilical. It also uses a vacuum or near vacuum and the total pressure of the ambient water to move a rod external to the housing. The rod assembly extends through the actuator body to the ambient environment. The extending end of the rod can be attached to or operate various devices. For example, in a Blow-Out Preventer, the rod end can be connected to a shearing device when the housing body of the integrated actuator is connected to a BOP structural body. In this application, two actuators may be installed facing in opposite directions and coaxially aligned to direct the rods into openings on the BOP body to produce a cutting or crushing force within the BOP body.

FIG. 1 illustrates a cross-sectional view of an actuator in accordance with an exemplary embodiment of the innovation. The actuator (500) has a housing (110) with two chambers (not designated) separated by a bulkhead (120) through which passes a rod (130A) having a piston (130B) attached to one end and a second piston (130C) along the rod's length. The rod (130A) extends through the housing (110) and projects to form a working end (135) to which various devices may be coupled. The rod (130A & 130D), its working end (135), and the pistons (130B & 130C) together form the piston assembly (130). The piston (130B) divides one chamber into a first cavity (101) and a second cavity (102). The piston (130C) divides the second chamber into a third cavity (103) and a fourth cavity (104).

A first port (160) opens to the first cavity (101). A second port (170) opens to the second cavity (102). A third port (180) opens to the third cavity (103) and is secured with a valve (185) operable by an ROV (10). A fourth port (190) opens to the fourth cavity (104). A piston seal (140) around the piston (130B) secures the first cavity (101) and the second cavity (102) against leakage there between. A rod seal (150) secures the second cavity (102) and the fourth cavity (104) against leakage there between. A piston seal (140) around the piston (130D) secures the fourth cavity (104) and the third cavity (103) against leakage there between. A rod seal (150) secures the third cavity (103) and the external environment against leakage there between.

Figure 2:
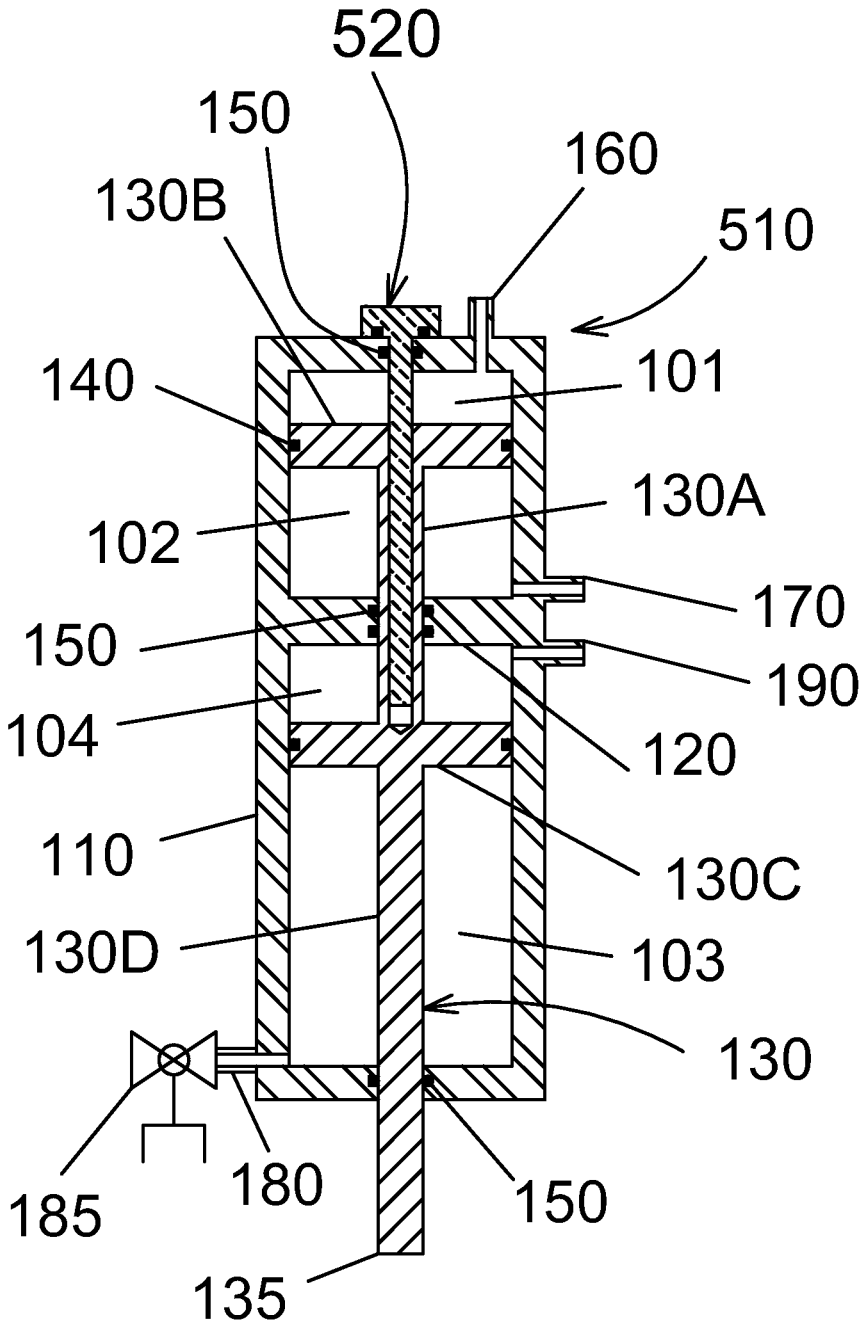
FIG. 2 illustrates a cross-sectional view of an actuator with a positioning sensor in accordance with an exemplary embodiment of the innovation.

FIG. 2 illustrates a cross-sectional view of an actuator with a position monitor in accordance with an exemplary embodiment of the innovation. This actuator (510) has a position sensor (520) which extends the length of the first chamber and determines the position of the rod assembly (130). In the preferred embodiment, the sensor is co-axial to the rod assembly (130) and slides into a void in the center of the rod.

Figure 3:
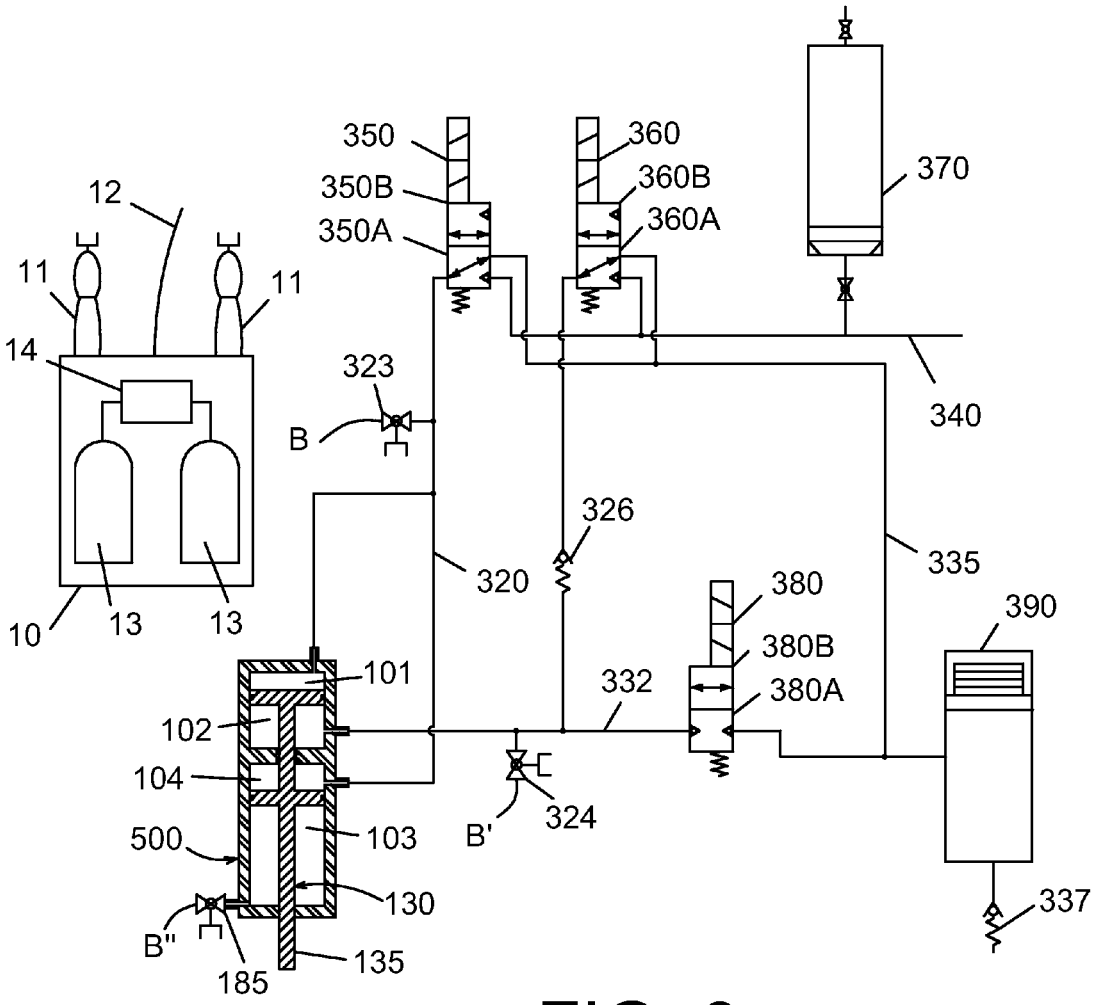
FIG. 3 illustrates a circuit diagram for use of an actuator utilizing umbilical fluid supplies in accordance with an exemplary embodiment of the innovation.

FIG. 3 illustrates a circuit diagram for use of an actuator utilizing umbilical fluid supplies in accordance with an exemplary embodiment of the innovation. The subsea actuator (500) comprises a piston assembly (130) which is moved between a fully retracted position and a fully extended position. Movement to the fully extended position is accomplished by creating a pressure differential where the pressure in the first cavity (101) is in excess of the pressure in the second cavity (102) and/or the pressure in the fourth cavity (104) is in excess of the pressure in the third cavity (103). Movement to the fully retracted position is accomplished by creating a pressure differential where the pressure in the second cavity (102) is in excess of the pressure in the first cavity (101). As the third cavity (103) is at or near a vacuum, it is not possible for its pressure to be increased over that of the fourth cavity (104), and the pressure differential between the second cavity (102) and the first cavity (101) must be sufficient to overcome the pressure differential between the third cavity (103) and the fourth cavity (104).

The force of the actuator may be controlled by manipulating which chambers have pressure differentials, and the quantity of those pressure differentials. The speed of the actuator may be controlled by regulating the speed at which fluid is allowed to escape the actuator cavities with the lower pressures and/or enter the actuator cavities with the higher pressures. One method of adjusting speed may be to partially open valves, or to cycle valves open and closed with a defined duty cycle.

During normal operation, a plurality of solenoid valves (350, 360, 380) and pressure relief or check valves (326, and 337) are used to route fluids through various lines (320, 332, and 335) from high pressure sources (340 and 370) and medium pressure sources (390) to create pressure differentials in cavities (101, 102, 103 and 104) which act against one another to position pistons (130B and 130C, designated in FIGS. 1 and 2) in the actuator (500). A plurality of valves (323, 324, and 185) may be remotely accessed and controlled by ROVs or other external manipulators to adjust or override the system's normal operation.

Figure 4:
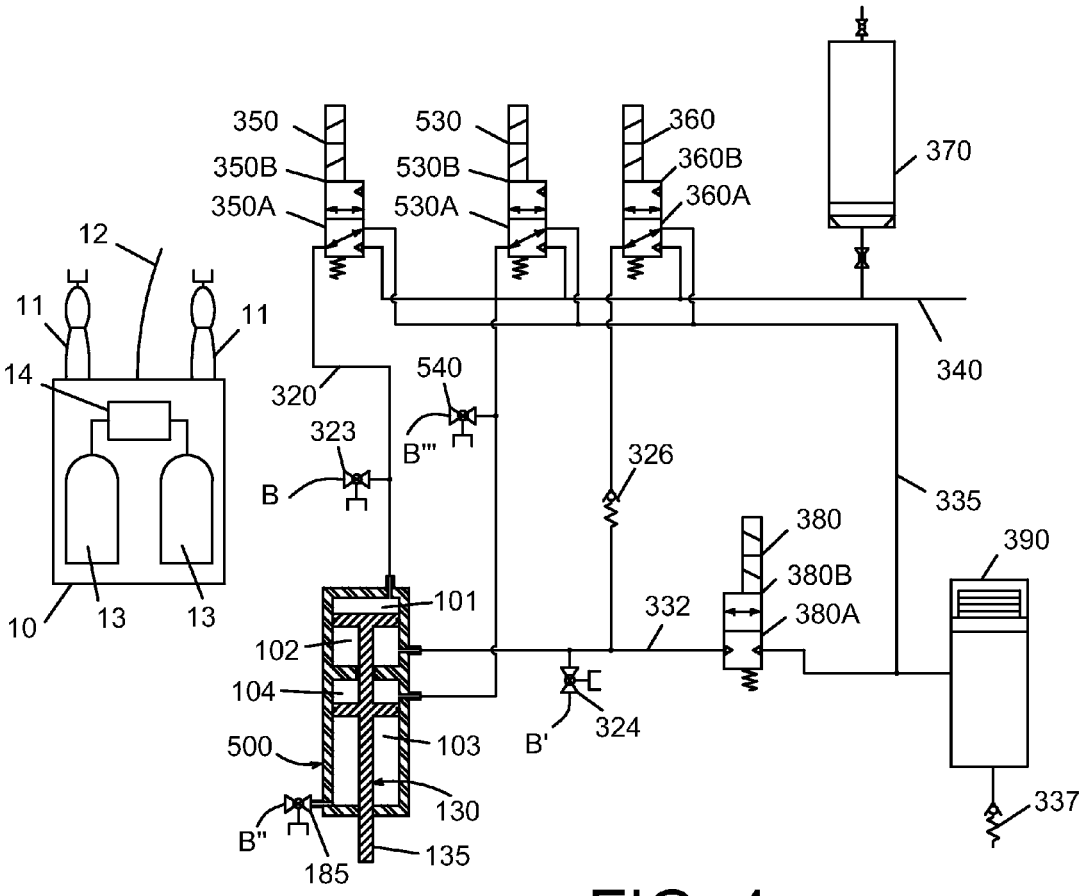
FIG. 4 illustrates a circuit diagram for use of an actuator with an alternative control configuration to allow finer manipulation of the actuator in accordance with an exemplary embodiment of the innovation.

FIG. 4 illustrates a circuit diagram for use of an actuator with an alternative control configuration to allow finer manipulation of the actuator. As in the previous system described in FIG. 3, an actuator (500) is controlled by various valves to manipulate the connection of cavities (101, 102, and 104) to high pressure sources (370 and 340) and medium pressure sources (390). This configuration allows individual control of pressures in the first cavity (101) and the fourth cavity (104). A valve (350) connects the first cavity (101) to a medium pressure source (390) when in the default position (350A) and to a high pressure source (370 and 340) when in the open position (350B). Another valve (530) connects the fourth cavity (104) to a medium pressure source (390) when in the default position (530A) and to a high pressure source (370 and 340) when in the open position (530B). A manual valve (540) allows an ROV (10) to connect a connection line (12) to the open connector (B''') and manipulate the valve via articulated arms (11) so the manifold and pump (14) may add or remove fluid to the ROV's (10) onboard pressure tanks (13).

The innovation described herein allows a plurality of pressure differentials to accommodate several desired operations. Further, the innovation described provides the ability to operate the actuator utilizing secondary pressure differentials available in the system when failures occur.

In normal operation, the subsea actuator is manipulated by establishing a pressure differential on both sides of the piston and allowing/causing the piston to relocate to adjust volume of the cylinder while attempting to equalize the pressure. It is common practice in subsea actuators that the pressure differential is a high pressure which is significantly above ambient pressure at depth, and an ambient pressure at depth. Both of these pressures are established in relation to the depth and may vary depending on the environment in which the innovation is utilized. In the inventor's previous patent, a sub actuator utilized a low pressure/vacuum to create a greater pressure differential. In this innovation, the low pressure/vacuum is incorporated into the actuator, thus reducing the cavity count from six to just four and reducing the size and complexity of the entire system, as well as eliminating inefficiencies of one or more flexible connection lines.

In reference to FIG. 3, the following description illustrates an exemplary operation which utilizes a high pressure supply (340) to move the subsea actuator (500) to a fully retracted position. To initiate the movement of the subsea actuator (500), the valve (360) is opened (360B) to connect the high pressure source (340), to the second cavity (102). This pressure differential caused by high pressure in the second cavity (102) and medium pressure in the first cavity (101) moves the piston assembly (130) retracting the actuator's working end (135), by decreasing the volume of the first cavity (101) and the fourth cavity (104), displacing the fluid through the line (320) and the valve (350) to the medium pressure reservoir (390). The pressure differential between the high pressure and the medium pressure is significant enough to overcome the opposing force of the medium pressure in the fourth cavity (104) and the vacuum in the third cavity (103).

Once the actuator reaches the desired position, the valve (360) is returned to the default position (360A) resulting in a medium pressure fluid in the first, second and fourth cavities (101, 102, and 104). The low pressure in the third cavity (103) biases the piston assembly (130) to move down. However, the check valve (326) and the default position (380A) of the valve (380) prevents fluid from leaving the second cavity (102), holding the actuator in the retracted position.

To move the actuator (500) to the fully extended position, the valve (380) is opened (380B) allowing fluid to exit the second cavity (102) as the vacuum in the third chamber (103) draws fluid into the first and fourth cavities (101 and 104). If additional force is needed, or faster speed is desired, then the valve (350) may be opened (350B) connecting the first and fourth cavities (101 and 104) to the high pressure sources (370 and 340).

In reference to FIG. 4, operations are similar to those described above. However, the addition of an independent valve (530) controlling fluid flow to and from the fourth cavity (104) independent of the valve (350), controlling fluid flow to and from the first cavity (101), allows greater control of the actuator's (500) speed and operating force. A lower operating pressure on the actuator's working end (135) is achieved by opening the valve (380B), which allows the second cavity (102) fluid to empty into the medium pressure reservoir (390) while allowing the other valves to remain in their default positions (350A & 360A). This results in a medium pressure to low pressure differential across the lower piston (130C), and no pressure differential across the upper piston (130B).

A higher operating pressure on the actuator's working end (135) is achieved by opening the valve (380B), and opening the valve (530A). This allows the second cavity (102) fluid to empty into the medium pressure reservoir (390) and adds high pressure fluid to the fourth cavity (104). This results in a high pressure to low pressure differential across the lower piston (130C), and no pressure differential across the upper piston (130B).

A higher operating pressure on the actuator's working end (135) is achieved by opening the valve (380B), and opening valve (350A). This allows the second cavity (102) fluid to empty into the medium pressure reservoir (390) and adds high pressure fluid to the first cavity (101). This results in a medium pressure to low pressure differential across the lower piston (130C), and a high pressure to medium pressure differential across the upper piston (130B).

The highest operating pressure on the actuator's working end (135) is achieved by opening the valve (380B), opening the valve (350A), and opening the valve (530A). This allows the second cavity (102) fluid to empty into the medium pressure reservoir (390) and adds high pressure fluid to the first cavity (101) and the fourth cavity (104). This results in a high pressure to low pressure differential across the lower piston (130C), and a high pressure to medium pressure differential across the upper piston (130B).

In the event the vacuum in the third cavity leaks or temporarily fails, it can be reestablished at depth by opening the valve (185) to the environment while cycling the actuator's working end (135) to the fully extended position, then closing the the valve (185) and cycling the actuator's working end (135) to the fully retracted position, thus reestablishing the vacuum in the third cavity (103).

The figures illustrate strategic placement of additional valves (185, 322, 323, 324, and 540) which are illustrated as Remote Operated Vehicle (ROV) valves utilizing industry standard symbols. In desired situations, an ROV can connect to one of these valves (185, 322, 323, and 324) to move the actuator (500) directly without concern for the operations of the rest of the system. Such operation may be desirable in situations where the high pressure supply line (340) umbilical is not connected and/or other high pressure supplies malfunction preventing normal operations. Another desired situation is when the solenoid valves (350, 360, 380, and 530) malfunction.

The chamber can be produced by machining the parts and assembling them. The parts may be made from metals, plastics, fiber composites, or other materials compatible with the environment. Standard elastomeric seals on the piston(s) may be used to seal the cavities from each other. The same manufacturing and assembly techniques used to manufacture hydraulic cylinders may be used to produce the chamber and the cavities within it. The balance of the parts required can be procured using readily available parts and assembled by persons skilled in the arts.

The methods and apparatus described may be relevant to all underwater operations and maybe useful, specifically in deep water in underwater military, scientific, and commercial oil and gas operations. Typical examples in the offshore oil and gas industries may include operation of equipment for drilling, coring, production, and all intervention operations. The system may be used in any underwater environment where a pressure differential can be generated or any environment where there may be a pressure differential generated by ambient conditions such as inside a pressure vessel or in a submarine.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The diagrams in accordance with exemplary embodiments of the present invention are provided as examples and should not be construed to limit other embodiments within the scope of the invention. For instance, heights, widths, and thicknesses may not be to scale and should not be construed to limit the invention to the particular proportions illustrated. Additionally, some elements illustrated in the singularity may actually be implemented in a plurality. Further, some elements illustrated in the plurality could actually vary in count.

For instance, the connection lines or valves should not be construed as necessary in a particular placement, or as individual components. Additional lines, valves, solenoids may be added, some may be removed, or the configuration may be altered and still be within the scope of the invention. Further, the systems in FIGS. 3 and 4 are illustrated with the unmonitored actuator shown in FIG. 1. Position monitored actuators, such as is shown in FIG. 2, may be utilized in the same fashion. Additionally, some valves are shown as solenoid valves, and others are shown as ROV or manual operated valves. The type of valve is not necessarily constrained by the version illustrated in the embodiment shown, and thus should be interpreted as illustrative for discussing exemplary embodiments. Such specific information is not provided to limit the invention.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. An underwater actuator comprising:

a pressure chamber including a first cavity, a second cavity, a third cavity, a fourth cavity, and a rod assembly comprising a first piston, a second piston, a rod, and a working end;

the first and second cavities being separated from the third and fourth cavities by a bulkhead;

the first cavity being separated from the second cavity by the first piston;

the third cavity being separated from the fourth cavity by the second piston;

the rod projecting through the bulkhead and at one end terminating in and connected to the first piston, the distal end of the rod extending through the third and fourth cavities, and projecting from the pressure chamber at the distal end to be the working end, the second piston fixedly connected along the length of the rod and moving therewith;

the third cavity including a gas at a first pressure being one of at or near surface pressure, or at a vacuum;

the first, second, and fourth cavities including a fluid at a second pressure, the second pressure being near underwater ambient pressure;

the flow of fluid to and from the cavities causing displacement of the pistons, and corresponding displacement of the working end of the rod projecting from the pressure chamber.

2. An underwater actuator as in claim 1, wherein said second cavity further comprises a port connected to a valve which may block flow to or from the cavity preventing the movement of the first piston.

3. An underwater actuator as in claim 1, wherein one or more of the first, second, and fourth cavities further includes the fluid being switched between the second pressure and a third pressure;

the third pressure being substantially higher than ambient pressure;

the difference in pressures causing flow of fluid to and from the cavities causing displacement of the pistons, and corresponding displacement of the working end of the rod projecting from the pressure chamber.

4. An underwater actuator as in claim 1, further comprising:

a position sensor;

said position sensor producing a signal corresponding to the position of the rod assembly in the pressure chamber.

5. An underwater actuator as in claim 4, wherein the position sensor signal is viewable externally at or near the pressure chamber.

6. An underwater actuator as in claim 4, wherein the position sensor signal is transmittable for remote viewing/monitoring.

7. An underwater actuator as described in claim 1, further comprising:

a plurality of valves connected to the first, second, and fourth cavities for controllably diverting fluid to and from the cavities thereby positioning the actuator.

8. An underwater actuator as described in claim 7 further comprising:

an accumulator which stores and supplies fluid at a pressure higher than the underwater ambient pressure.

9. An underwater actuator as described in claim 7 further comprising:

a pump which compresses ambient fluid into an accumulator which stores and supplies fluid at a pressure higher than the underwater ambient pressure, and discharges excess medium pressure fluid to the external environment.

10. An underwater actuator as described in claim 8, further comprising:

a hydraulic reservoir for receiving fluid at underwater ambient pressure and storing said fluid for reuse.

11. An underwater actuator as described in claim 10, wherein fluid from the reservoir is pumped to the accumulator.

12. An underwater actuator as described in claim 7, wherein the valves are solenoid valves operated by remote command from a controller.

13. An underwater actuator as described in claim 7, wherein the valves are solenoid valves operated by automatic response from a monitoring unit.

14. An underwater actuator as described in claim 7 wherein the valves are manually operable by a diver.

15. An underwater actuator as described in claim 7 wherein the valves are operable by a remotely operated vehicle.

16. An underwater actuator as described in claim 15 further including one or more ports selectively engagable by the remotely operated vehicle, to adjust fluid pressures and/or quantities in at least one of the cavities.

17. An underwater actuator system comprising:

a pressure chamber including a first cavity, a second cavity, a third cavity, a fourth cavity, and a rod assembly comprising a first piston, a second piston, a rod, and a working end;

the first and second cavities being separated from the third and fourth cavities by a bulkhead;

the first cavity being separated from the second cavity by the first piston;

the third cavity being separated from the fourth cavity by the second piston;

the rod projecting through the bulkhead and at one end terminating in and connected to the first piston, the distal end of the rod extending through the third and fourth cavities, and projecting from the pressure chamber at the distal end to be the working end, the second piston fixedly connected along the length of the rod and moving therewith;

an accumulator which stores and supplies fluid at a pressure higher than the underwater ambient pressure;

a hydraulic reservoir for receiving fluid at underwater ambient pressure and storing said fluid for reuse;

a plurality of valves connected to the first, second, and fourth cavities;

the third cavity including a gas at a first pressure being one of at or near surface pressure, or at a vacuum;

the first, second, and fourth cavities including a fluid switched by the valves between a second pressure and a third pressure;

the second pressure being near underwater ambient pressure;

the third pressure being substantially higher than ambient pressure;

wherein the valves are solenoid valves operated by automatic response from a monitoring unit to controllably divert fluid to and from the cavities thereby positioning the actuator.

18. An underwater actuator system as described in claim 17 further comprising:

a positioning sensor monitored by the monitoring unit;

the monitoring unit accepting a desired position setting as an input;

and automatically controlling the valves to achieve precise positioning of the rod assembly based on the input.

19. An underwater actuator system as described in claim 17 wherein the hydraulic reservoir is the external environment.

a positioning sensor monitored by the monitoring unit;

the monitoring unit accepting a desired position setting as an input;

and automatically controlling the valves to achieve precise positioning of the rod assembly based on the input.

* * * * *